US008681054B2

(12) United States Patent
Wang et al.

(10) Patent No.: US 8,681,054 B2
(45) Date of Patent: Mar. 25, 2014

(54) PIFA/MONOPOLE HYBRID ANTENNA AND MOBILE COMMUNICATIONS DEVICE HAVING THE SAME

(75) Inventors: Ching-Sung Wang, Taoyuan (TW); Min-Che Chen, Taoyuan (TW); Kuo-Cheng Chen, Taoyuan (TW)

(73) Assignee: HTC Corporation, Taoyuan (TW)

( * ) Notice: Subject to any disclaimer, the term of this patent is extended or adjusted under 35 U.S.C. 154(b) by 1021 days.

(21) Appl. No.: 11/905,267

(22) Filed: Sep. 28, 2007

(65) Prior Publication Data

US 2009/0085813 A1 Apr. 2, 2009

(51) Int. Cl.
*H01Q 1/24* (2006.01)

(52) U.S. Cl.
USPC ..... 343/702

(58) Field of Classification Search
USPC ..... 343/702
See application file for complete search history.

(56) References Cited

U.S. PATENT DOCUMENTS

| | | | | |
|---|---|---|---|---|
| 6,603,432 | B2 * | 8/2003 | Hill et al. | 343/702 |
| 6,650,298 | B2 | 11/2003 | Abbasi et al. | |
| 6,963,310 | B2 | 11/2005 | Horita et al. | |
| 7,057,560 | B2 | 6/2006 | Erkocevic | |
| 7,629,932 | B2 * | 12/2009 | Wang et al. | 343/702 |
| 7,671,804 | B2 * | 3/2010 | Zhang et al. | 343/700 MS |
| 2004/0085244 | A1 * | 5/2004 | Kadambi et al. | 343/700 MS |
| 2004/0201530 | A1 * | 10/2004 | Wen et al. | 343/725 |
| 2007/0035451 | A1 * | 2/2007 | Yang et al. | 343/700 MS |
| 2007/0229371 | A1 * | 10/2007 | Rowell | 343/702 |

FOREIGN PATENT DOCUMENTS

| | | | |
|---|---|---|---|
| CN | 1455969 | A | 11/2003 |
| CN | 2838056 | Y | 11/2006 |
| TW | I227576 | | 2/2005 |
| TW | I229473 | | 3/2005 |

* cited by examiner

*Primary Examiner* — Robert Karacsony
(74) *Attorney, Agent, or Firm* — Birch, Stewart, Kolasch & Birch, LLP

(57) ABSTRACT

A PIFA/monopole hybrid antenna includes a high-frequency radiator, a low-frequency radiator, a connecting part, a feed part, and a ground part. The high-frequency radiator includes a first radiating part and a second radiating part extended substantially perpendicular to the first radiating part. The low-frequency radiator includes a third radiating part extended substantially parallel to the first radiating part, and a fourth radiating part extended substantially perpendicular to the third radiating part. The connecting part is connected between the high-frequency radiator, the low-frequency radiator, the connecting part, the feed part, and the ground part.

14 Claims, 2 Drawing Sheets

PIFA/MONOPOLE HYBRID ANTENNA AND MOBILE COMMUNICATIONS DEVICE HAVING THE SAME

BACKGROUND OF THE INVENTION

1. Field of the Invention

The invention relates to a PIFA/monopole hybrid antenna and a mobile communications device provided with the PIFA/monopole hybrid antenna.

2. Description of the Related Art

Internal antennas are increasingly popular and widely used in mobile communications devices (e.g. cellular phones). Recently, planner inverted F antennas (PIFAs) and monopole antennas have become available.

A planner inverted F antenna is required to be spaced apart from a circuit board of a mobile communications device at a predetermined vertical distance, and no electronic components are allowed between the planner inverted F antenna and the circuit board. However, the predetermined vertical distance is limited by the thickness of the mobile communications device which is generally small. As a result, the performance of the antenna measured in bandwidth, radiation efficiency, and gain is hindered.

Differing from PIFAs, a monopole antenna is required to be spaced apart from the electronic components of the circuit board of a mobile communications device at a predetermined horizontal distance. That is, a clearance zone is required between the monopole antenna and the electronic components of the circuit board to avoid negative disturbances to the monopole antenna. Therefore, the dimensions of monopole antennas are suitable for slim type communications devices. In operation, however, the monopole antenna has a problem of a higher specific absorption rate (SAR) in the human body and is more susceptible to phantom effect.

BRIEF SUMMARY OF THE INVENTION

The invention provides a hybrid antenna having merits of the PIFA and monopole antennas and is capable of operating at frequencies of 824-894 MHz, 880-960 MHz, 1710-1880 MHz, and 1850-1990 MHz. Following experimentation, the hybrid antenna requires only a 2.2 mm height clearance from the circuit board, and thus is suitable for slim type communications devices. In addition, the SAR in the human body and phantom effect are significantly reduced.

The PIFA/monopole hybrid antenna in accordance with an exemplary embodiment of the invention includes a high-frequency radiator, a low-frequency radiator, a connecting part, a feed part, and a ground part. The high-frequency radiator includes a first radiating part and a second radiating part extended substantially perpendicular to the first radiating part such that a surface of the second radiating part is also substantially perpendicular to a surface of the first radiating part. The low-frequency radiator includes a third radiating part extended substantially parallel to the first radiating part, and a fourth radiating part extended substantially perpendicular to the third radiating part such that a surface of the fourth radiating part is also substantially perpendicular to a surface of the third radiating part. The connecting part is connected between the high-frequency radiator, the low-frequency radiator, the connecting part, the feed part, and the ground part.

The above-mentioned PIFA/monopole hybrid antenna can be modified in various ways. In another exemplary embodiment of the invention, for example, the low-frequency radiator is longer than the high-frequency radiator.

In another exemplary embodiment of the invention, as another example, the high-frequency radiator is able to resonate with signals of 1710-1880 MHz and 1850-1990 MHz.

In another exemplary embodiment of the invention, the low-frequency radiator is able to resonate with signals of 824-894 MHz and 880-960 MHz.

In another exemplary embodiment of the invention, the feed part is a resilient tab.

In another exemplary embodiment of the invention, the ground part is a resilient tab.

The invention also provides a mobile communications device which includes a circuit board and a PIFA/monopole hybrid antenna. The circuit board includes a feed point, a ground, and a clearance zone thereon. The PIFA/monopole hybrid antenna includes a feed part, a ground part, a high-frequency radiator, a low-frequency radiator, and a connecting part. The feed part is electrically connected to the feed point of the circuit board. The ground part is electrically connected to the ground of the circuit board. The high-frequency radiator includes a first radiating part disposed adjacent to the clearance zone and a second radiating part extended from the first radiating part inward along the circuit board such that a surface of the second radiating part is substantially perpendicular to a surface of the first radiating part. The low-frequency radiator includes a third radiating part disposed adjacent to the clearance zone and a fourth radiating part extended from the third radiating part inward along the circuit board such that a surface of the fourth radiating part is substantially perpendicular to a surface of the third radiating part. The connecting part is connected between the high-frequency radiator, the low-frequency radiator, the connecting part, the feed part, and the ground part.

In another exemplary embodiment of the mobile communications device, the first radiating part runs substantially parallel to the third radiating part.

In another exemplary embodiment of the mobile communications device, the second radiating part runs substantially parallel to the fourth radiating part.

In another exemplary embodiment of the mobile communications device, the second radiating part is spaced apart from the clearance zone of the circuit board at about 2.2 mm.

In another exemplary embodiment of the mobile communications device, the fourth radiating part is spaced apart from the clearance zone of the circuit board at about 2.2 mm.

In another exemplary embodiment of the mobile communications device, the low-frequency radiator is longer than the high-frequency radiator.

In another exemplary embodiment of the mobile communications device, the high-frequency radiator is able to resonate with signals of 1710-1880 MHz and 1850-1990 MHz.

In another exemplary embodiment of the mobile communications device, the low-frequency radiator is able to resonate with signals of 824-894 MHz and 880-960 MHz.

In another exemplary embodiment of the mobile communications device, the ground part of the PIFA/monopole hybrid antenna is a resilient tab abutting the ground of the circuit board.

In another exemplary embodiment, the mobile communications device further includes a mount with the PIFA/monopole hybrid antenna affixed thereto.

In another exemplary embodiment, the mount is made of plastic.

In another exemplary embodiment, the PIFA/monopole hybrid antenna is affixed to the mount by ultrasonic heat staking.

In another exemplary embodiment, the mobile communications device further includes a housing accommodating the circuit board, the PIFA/monopole hybrid antenna, and the mount, and a screw affixing the mount and the circuit board to the housing.

As described, the PIFA/monopole hybrid antenna requires only a 2.2 mm height clearance from the circuit board, and thus is suitable for slim type communications devices. Furthermore, the PIFA/monopole hybrid antenna, disposed at the rear of the mobile communications device, extends inward along the circuit board. This arrangement effectively eliminates the phantom effect and significantly reduces the specific absorption rate (SAR) in the human body.

Furthermore, both the feed part and the ground part are resilient tabs extending from the connecting part of the PIFA/monopole hybrid antenna and electrically contacted to the circuit board. This structure is easy to manufacture and is inexpensive.

Furthermore, the mount and the circuit board are firmly connected to the housing by screws, which is easy and fast during assembly. Furthermore, such a connection is reliable. Even when the mobile communications device impacts the ground, the mount and the circuit board does not separate from the housing.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
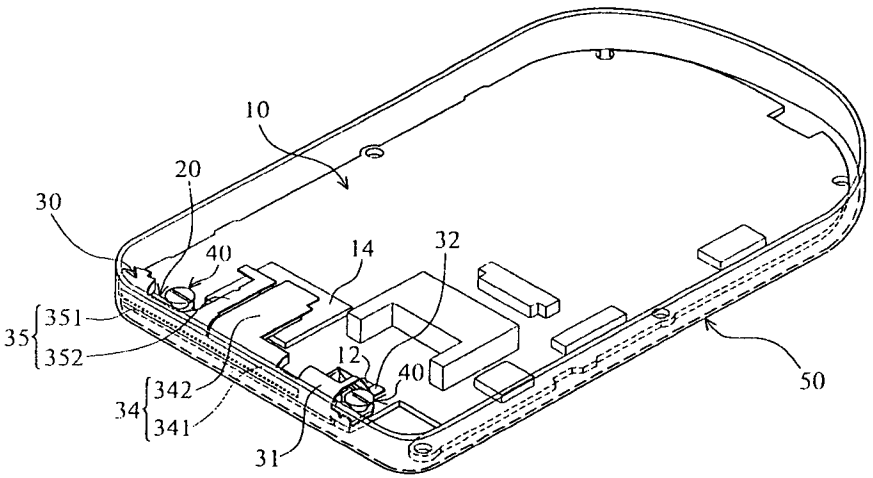
FIG. 1 depicts the rear of a mobile communications device in accordance with an embodiment of the invention.
Figure 2:
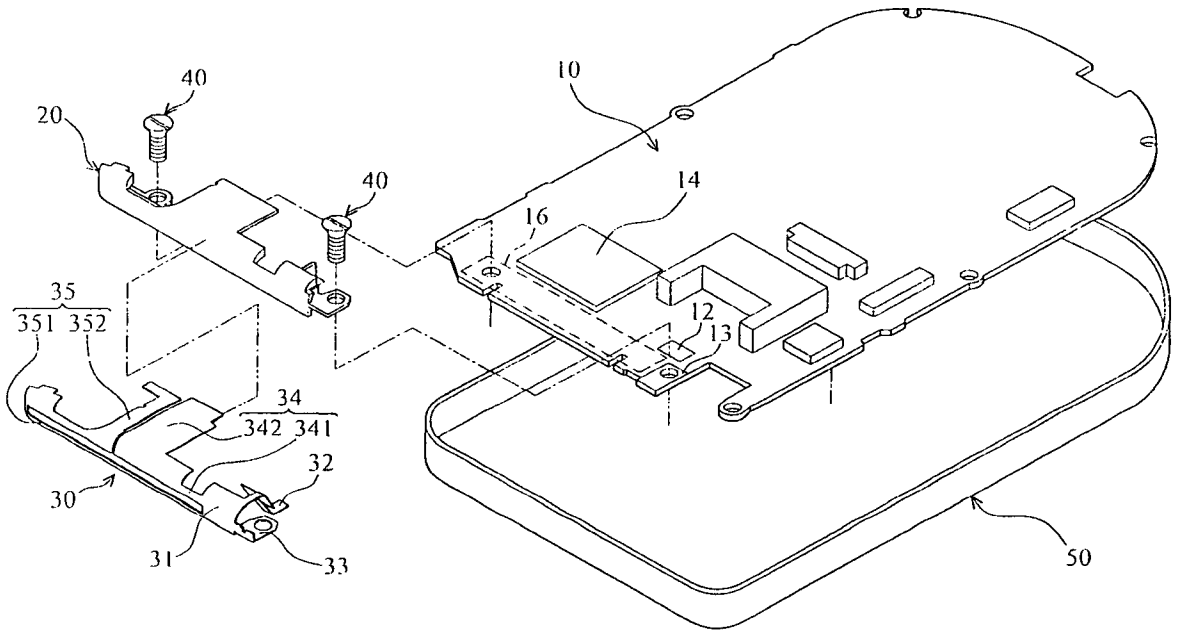
FIG. 2 is a perspective exploded diagram of the mobile communications device of FIG. 1.

FIGS. 1 and 2 depicts the rear of a mobile communications device in accordance with an embodiment of the invention, wherein the mobile communications device 50 (e.g. a cellular phone) includes a circuit board 10, a PIFA/monopole hybrid antenna 30, and a mount 20, all of which are disposed in a housing 50. The circuit board 10 has a feed point 13, a ground 12, a clearance zone 16, and a plurality of electronic components 14 thereon, wherein the clearance zone 16 is formed adjacent to an edge of the circuit board 10 and no electronic components are provided in the clearance zone 16. In this embodiment, the PIFA/monopole hybrid antenna 30 is made of phosphor bronze and the mount 20 is made of plastic. The PIFA/monopole hybrid antenna 30 is affixed to the mount 20 by ultrasonic heat staking, while the mount 20 and the circuit board 10 are affixed to the housing 50 by screws 40.

The PIFA/monopole hybrid antenna 30 includes a feed part 33, a ground part 32, a high-frequency radiator 34, a low-frequency radiator 35, and a connecting part 31 connected between the feed part 33, the ground part 32, the high-frequency radiator 34, and the low-frequency radiator 35. All parts of the PIFA/monopole hybrid antenna 30 are described in detail in the following:

The feed part 33 is a resilient tab affixed to the feed point 13 of the circuit board 10 by a screw 40, thus forming an electrical connection therebetween.

The ground part 32 is a resilient tab abutting the ground 12 of the circuit board 10, thus forming an electrical connection therebetween.

The high-frequency radiator 34 is able to resonate with high frequency signals of 1710-1880 MHz and 1850-1990 MHz. Furthermore, the high-frequency radiator 34 includes a first radiating part 341 extended from the connecting part 31 and a second radiating part 342 extended substantially perpendicular to the first radiating part 341 such that a surface of the second radiating part 342 is also substantially perpendicular to a surface of the first radiating part 341. When the hybrid antenna 30 is affixed to the circuit board 10 by screws 40, the first radiating part 341 is disposed adjacent to the clearance zone 16 and the second radiating part 342 is extended from the first radiating part 341 inward along the circuit board 10 and spaced apart from the circuit board 10 at a height of about 2.2 mm such that a surface of the second radiating part 342 is substantially perpendicular to a surface of the first radiating part 341.

The low-frequency radiator 35 is longer than the high-frequency radiator 34 for being able to resonate with low frequency signals of 824-894 MHz and 880-960 MHz. The low-frequency radiator 35 includes a third radiating part 351 extended from the connecting part 31 and a fourth radiating part 352 extended substantially perpendicular to the third radiating part 351 such that a surface of the fourth radiating part 352 is also substantially perpendicular to a surface of the third radiating part 351. When the hybrid antenna 30 is affixed to the circuit board 10 by screws 40, the third radiating part 351 is disposed adjacent to the clearance zone 16 and the fourth radiating part 352 is extended from the third radiating part 351 inward along the circuit board 10 and spaced apart from the circuit board 10 at a height of about 2.2 mm such that a surface of the fourth radiating part 352 is substantially perpendicular to a surface of the third radiating part 351.

The invention provides a hybrid antenna having merits of PIFA and monopole antennas and capable of operating at frequencies of 824-894 MHz, 880-960 MHz, 1710-1880 MHz, and 1850-1990 MHz. Following experimentation, the hybrid antenna requires only a 2.2 mm height clearance from the circuit board, and thus is suitable for slim type communications devices.

Meanwhile, the PIFA/monopole hybrid antenna 30, disposed at the rear of the communications device, extends inward along the circuit board 10. This arrangement effectively eliminates the phantom effect and significantly reduces specific absorption rate (SAR) in the human body.

Furthermore, both the feed part 33 and the ground part 32 are resilient tabs extending from the connecting part 31 of the PIFA/monopole hybrid antenna and electrically contacting the circuit board 10. This structure is easy to manufacture and is inexpensive.

Furthermore, the mount 20 and the circuit board 10 are firmly connected to the housing 50 by screws 40, which is easy and fast during assembly. Furthermore, such a connection is reliable. Even when the mobile communications device impacts the ground, the mount 20 and the circuit board 10 does not separate from the housing 50.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A hybrid antenna, electrically connected to a circuit board, comprising:

a feed part;

a ground part;

a high-frequency radiator including a first radiating part extended along a longitudinal axis thereof and a second radiating part extended substantially perpendicular to the first radiating part, wherein the first radiating part substantially lies in a vertical plane, and the second radiating part is formed at the end of the high-frequency radiator, parallel to the circuit board, and substantially lies in a horizontal plane, perpendicular to the vertical plane;

a low-frequency radiator including a third radiating part disposed on the longitudinal axis of the first radiating part and extended substantially parallel to the first radiating part, and a fourth radiating part extended substantially perpendicular to the third radiating part, wherein the third radiating part substantially lies in the vertical plane, parallel to the first radiating part, and the fourth radiating part is formed at the end of the low-frequency radiator, parallel to the circuit board, and substantially lies in the horizontal plane, perpendicular to the vertical plane;

a connecting part connected between the feed part, the ground part, the high-frequency radiator and the low-frequency radiator, wherein the first radiating part is formed between the second radiating part and the connecting part, and the third radiating part is formed between the fourth radiating part and the connecting part;

a mount with the hybrid antenna affixed thereto; and a screw affixing the mount to the circuit board, and forming an electrical connection between the hybrid antenna and the circuit board.

2. The mobile communications device as claimed in claim 1, wherein the first radiating part runs substantially parallel to the third radiating part.

3. The mobile communications device as claimed in claim 1, wherein the second radiating part runs substantially parallel to the fourth radiating part.

4. The hybrid antenna as claimed in claim 1, wherein the high-frequency radiator resonates with signals of 1710-1880 MHz and 1850-1990 MHz.

5. The hybrid antenna as claimed in claim 1, wherein the low-frequency radiator resonates with signals of 824-894 MHz and 880-960 MHz.

6. The hybrid antenna as claimed in claim 1, wherein at least one of the feed part and the ground part is a resilient tab.

7. A mobile communications device, comprising:

a circuit board including a feed point, a ground, and a clearance zone thereon;

a hybrid antenna including:

a feed part electrically connected to the feed point;

a ground part electrically connected to the ground;

a high-frequency radiator including a first radiating part extended along a longitudinal axis thereof and a second radiating part extended substantially perpendicular to the first radiating part, wherein the first radiating part substantially lies in a vertical plane, and the second radiating part is formed at the end of the high-frequency radiator, parallel to the circuit board, and substantially lies in a horizontal plane, perpendicular to the vertical plane;

a low-frequency radiator including a third radiating part disposed on the longitudinal axis of the first radiating part and extended substantially parallel to the first radiating part, and a fourth radiating part extended substantially perpendicular to the third radiating part, wherein the third radiating part substantially lies in the vertical plane, parallel to the first radiating part, and the fourth radiating part is formed at the end of the low-frequency radiator, parallel to the circuit board, and substantially lies in the horizontal plane, perpendicular to the vertical plane;

a connecting part connected between the feed part, the ground part, the high-frequency radiator, and the low-frequency radiator, wherein the first radiating part is formed between the second radiating part and the connecting part, and the third radiating part is formed between the fourth radiating part and the connecting part;

a mount with the hybrid antenna affixed thereto; and a screw affixing the mount to the circuit board, and forming an electrical connection between the feed part of the hybrid antenna and the feed point of the circuit board; and a housing accommodating the circuit board, the hybrid antenna, and the mount.

8. The mobile communications device as claimed in claim 7, wherein the second radiating part is spaced apart from the circuit board at about 2.2 mm.

9. The mobile communications device as claimed in claim 7, wherein the fourth radiating part is spaced apart from the circuit board at about 2.2 mm.

10. The mobile communications device as claimed in claim 7, wherein the high-frequency radiator resonates with signals of 1710-1880 MHz and 1850-1990 MHz.

11. The mobile communications device as claimed in claim 7, wherein the low-frequency radiator resonates with signals of 824-894 MHz and 880-960 MHz.

12. The mobile communications device as claimed in claim 7, wherein the ground part of the hybrid antenna is a resilient tab abutting the ground of the circuit board.

13. The mobile communications device as claimed in claim 7, wherein the mount is made of plastic.

14. The mobile communications device as claimed in claim 7, wherein the hybrid antenna is affixed to the mount by ultrasonic heat staking.

* * * * *